US006135923A

United States Patent [19]

Stearns et al.

[11] Patent Number: 6,135,923

[45] Date of Patent: Oct. 24, 2000

[54] EXERCISE METHODS AND APPARATUS

[76] Inventors: Kenneth W. Stearns, P.O. Box 55912, Houston, Tex. 77055; Joseph D. Maresh, P.O. Box 645, West Linn, Oreg. 97068-0645

[21] Appl. No.: 09/273,861

[22] Filed: Mar. 22, 1999

Related U.S. Application Data

[63] Continuation-in-part of application No. 09/065,308, Apr. 23, 1998, Pat. No. 5,707,321.

[60] Provisional application No. 60/102,444, Sep. 30, 1998.

[51] Int. Cl.[7] ..... A63B 22/12; A63B 22/00

[52] U.S. Cl. ..... 482/51; 482/52; 482/62

[58] Field of Search ..... 482/51, 52, 53, 482/57, 62, 70, 71, 79, 80, 148

[56] References Cited

U.S. PATENT DOCUMENTS

| | | | |
|---|---|---|---|
| 4,880,225 | 11/1989 | Lucas et al. | 482/62 |
| 5,499,956 | 3/1996 | Habing et al. | 482/52 |
| 5,611,756 | 3/1997 | Miller | 482/52 |
| 5,653,662 | 8/1997 | Rodgers, Jr. | 482/70 |
| 5,846,166 | 12/1998 | Kuo | 482/52 |
| 5,913,751 | 6/1999 | Eschenbach | 482/57 |
| 5,921,894 | 7/1999 | Eshenbach | 482/57 |
| 5,928,115 | 7/1999 | Arroyo, Jr. | 482/62 |
| 6,019,710 | 2/2000 | Dalebout et al. | 482/70 |

*Primary Examiner*—Stephen R. Crow

[57] ABSTRACT

An exercise apparatus has left and right user supporting assemblies which support a person in an upright position relative to an underlying floor surface. The user supporting assemblies are interconnected between the frame and respective left and right cranks in such a manner that rotation of the cranks is linked to movement of respective foot supports and handles through generally vertical paths of motion.

16 Claims, 11 Drawing Sheets

EXERCISE METHODS AND APPARATUS

CROSS-REFERENCE TO RELATED APPLICATION

This application is a continuation-in-part of U.S. patent application Ser. No. 09/065,308, which was filed on Apr. 23, 1998, and which is a continuation of U.S. Pat. No. 5,707,321, issued on Jan. 13, 1998; and this application discloses subject matter entitled to the filing date of Provisional Application Ser. No. 60/102,444, which was filed on Sept. 30, 1998.

FIELD OF THE INVENTION

The present invention relates to exercise methods and apparatus, and the preferred embodiment is a climbing machine which coordinates vertical hand movement with foot movement through elliptical paths having vertical major axes.

BACKGROUND OF THE INVENTION

One known type of exercise apparatus is sometimes characterized as a "climber" machine in the exercise industry. Such a machine has a frame which rests upon a floor surface and provides a vertical rail. Foot supports and handles are movable up and down along the rail in a manner which is somewhat similar to climbing a ladder. An object of the present invention is to provide an improved climber machine.

SUMMARY OF THE INVENTION

In one respect, the present invention may be seen to provide a novel linkage assembly and corresponding exercise apparatus suitable for linking circular motion to relatively more complex, generally elliptical motion. In particular, first portions of left and right connector links are rotatably connected to respective cranks; second portions of the connector links are constrained to move through similar fixed paths; and third portions of the connector links provide support for respective left and right foot platforms. The arrangement links rotation of the cranks to movement of the foot platforms through similar elliptical paths.

In another respect, the present invention may be seen to provide a novel exercise apparatus which simulates a climbing motion by linking the elliptical movement of the foot platforms to generally vertical movement of left and right handles. In this regard, left and right body supporting links extend upward from respective connector links to respective second portions which are constrained to move through similar fixed paths. The handles are connected to respective body supporting links proximate respective second portions. The foot platforms and the handles cooperate to support a person in a generally upright position while facilitating movement of the person's feet and hands through paths which are generally perpendicular to an underlying floor surface.

In yet another respect, the present invention may be seen to provide a novel exercise apparatus which is adjustable to accommodate people of various sizes and/or levels of fitness. In particular, the handles may be selectively moved along the body supporting links to place more or less distance between the handles and the foot platforms. Fixed handles may be provided on the frame, as well.

In still another respect, the present invention may be seen to facilitate foot travel through any of several fixed elliptical paths. In this regard, the constraint imposed on the second portions of the connector links may be moved relative to the crank axis to adjust the exercise stroke. Many of the features and advantages of the present invention may become more apparent from the detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

The present invention provides exercise apparatus which link rotation of left and right cranks to movement of left and right foot supporting members through generally elliptical paths which are generally vertical. The terms "elliptical" and "generally elliptical" are intended in a broad sense to describe a closed curved path of motion having a relatively longer first axis or major axis and a relatively shorter second axis or minor axis. The terms "vertical" and "generally vertical" are intended in a broad sense to describe an angle between forty-five and ninety degrees relative to the ground or an underlying floor surface.

Figure 8:
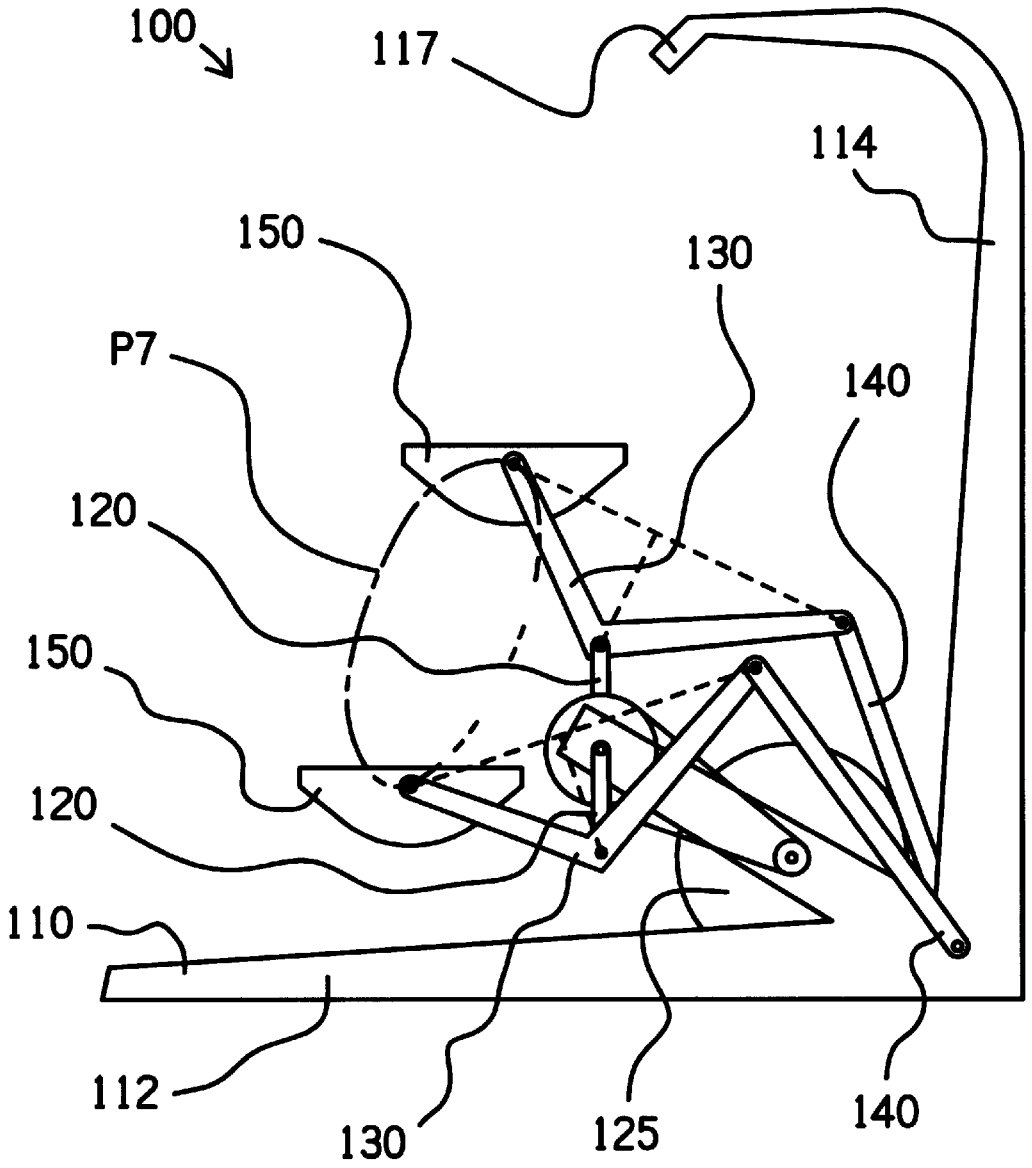
FIG. 8 is a side view of another exercise apparatus, which shares similarities with the exercise apparatus of FIG. 1.

FIG. 8 shows an exercise apparatus 100 which encourages a person's feet to travel through adjacent generally elliptical paths P7, each of which has a generally vertical major axis. The two foot supports 150 occupy respective positions which are approximately one hundred and eighty degrees out of phase relative to one another. The apparatus 100 is disclosed in U.S. Pat. No. 5,707,321, which is incorporated herein by reference.

Among other things, the apparatus 100 includes a frame 110 having a base 112 designed to rest upon a floor surface, and a forward stanchion 114 extending upward from the base 112. Although this description includes references to directions, such as forward or rearward, those skilled in the art will recognize that the present invention is not strictly limited by such references. Fixed handles 117 are mounted to an upper end of the stanchion 114 to provide stable hand grips for a person standing on the foot supports 150.

Left and right cranks 120 are rotatably mounted on the frame 110 and rotate about a common crank axis relative thereto. The cranks 120 are connected to a stepped-up flywheel 125 in a manner known in the art. Those skilled in the art will recognize that various known resistance devices may be connected to the flywheel 125 to resist rotation thereof.

Left and right connector links 130 have first portions rotatably connected to respective cranks 120, second portions rotatably connected to respective rocker links 140, and third portions rotatably connected to respective foot supports 150. Stops are provided on the foot supports 150 to keep them in a relatively horizontal orientation through an exercise cycle. The connector links 130 are configured so the second and third portions are disposed at opposite, distal ends, and the first portions are disposed intermediate the second portions and the third portions. An opposite end of each rocker link 140 is rotatably connected to the frame 110.

Figure 9:
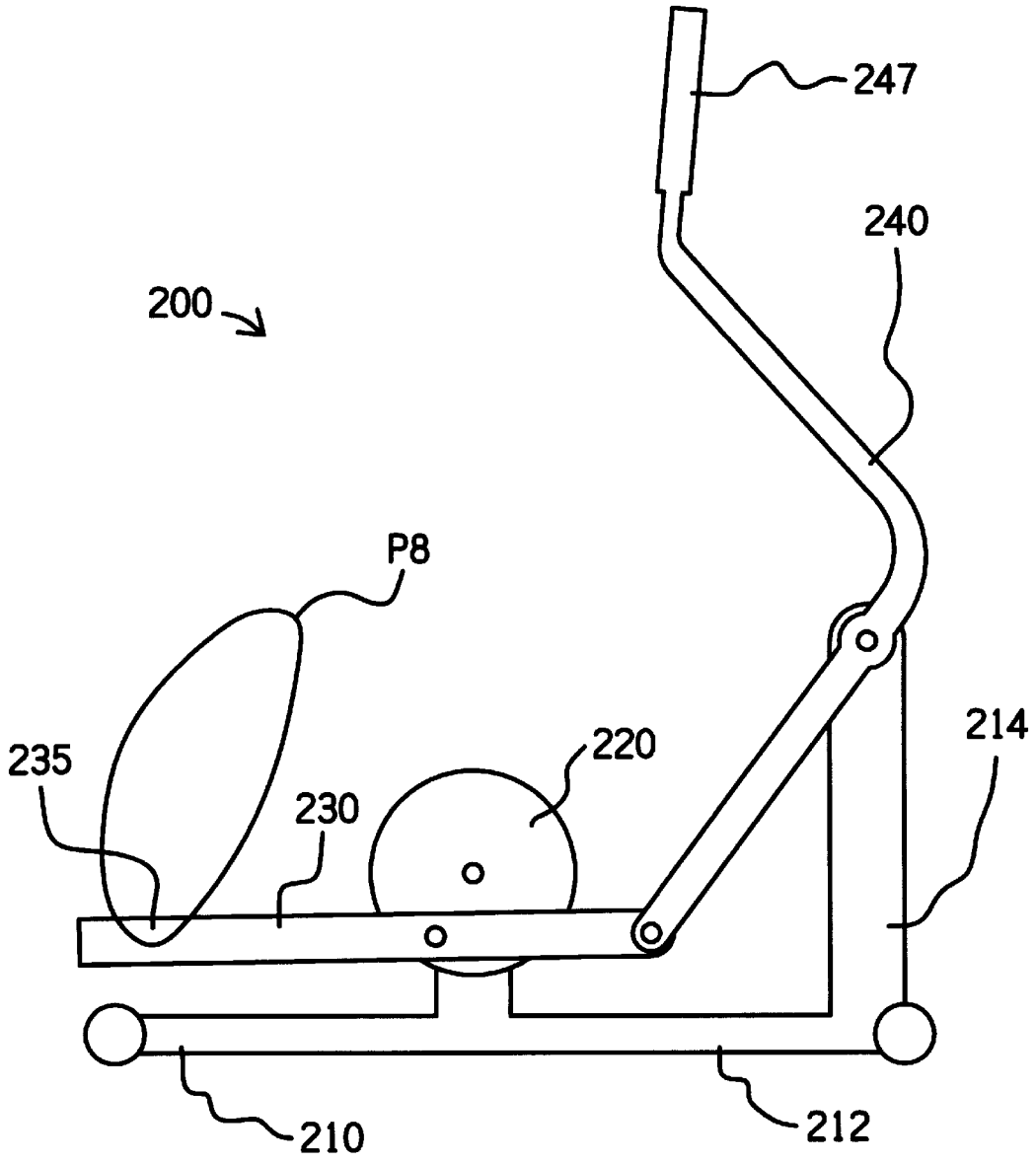
FIG. 9 is a side view of yet another exercise apparatus, which shares similarities with the exercise apparatus of FIG.

FIG. 9 shows an exercise apparatus 200 which encourages a person's feet to travel through adjacent elliptical paths P8, each of which has a generally vertical major axis. Although only one side of the linkage assembly is shown in FIG. 9, those skilled in the art will recognize that opposite side counterparts are arranged to be approximately one hundred and eighty degrees out of phase relative to the parts shown.

The apparatus includes a frame 210 having a floor engaging base 212, a forward stanchion 214 that extends upward from the base 212, and an intermediate stanchion that extends upward from the base. Left and right cranks 220 are rotatably mounted on the intermediate stanchion. An outer end of each crank 220 is rotatably connected to an intermediate portion of a respective connector link 230. A rearward portion 235 of each connector link 230 is configured to support a person's foot.

The apparatus 200 demonstrates one way to modify the previous embodiment 100 to accommodate both upper body and lower body exercise. In particular, each rocker link 240 has a lower portion connected to a forward portion of a respective connector link 230, an intermediate portion rotatably connected to the forward stanchion 214, and an upper portion 247 sized and configured for grasping in a person's hand. As a result of this arrangement, the handles 247 move through arcuate paths as the foot supports 235 move through the generally elliptical paths P8.

Figure 10:
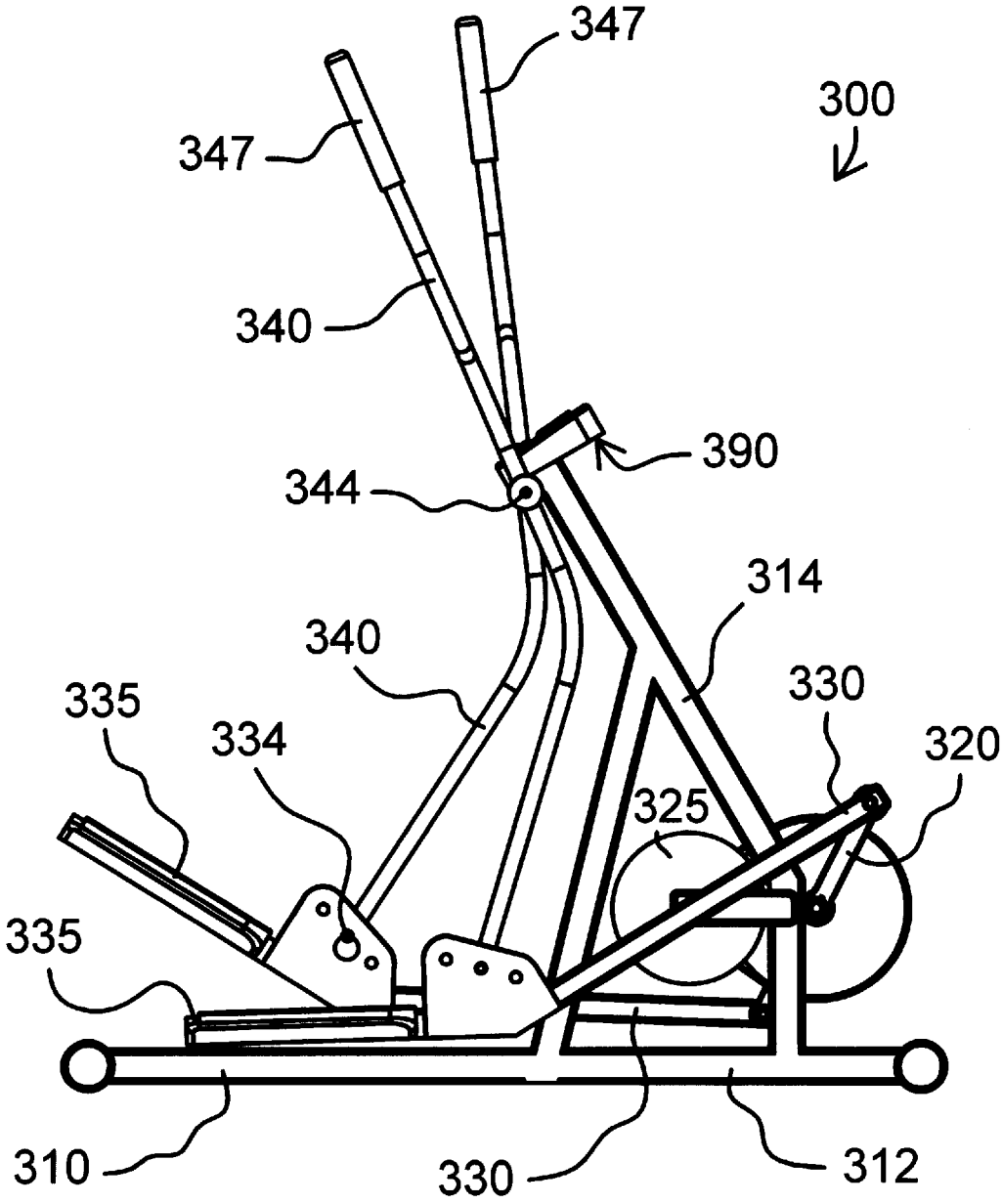
FIG. 10 is a side view of yet another exercise apparatus, which shares similarities with the exercise apparatus of FIG. 1.

FIG. 10 shows another exercise apparatus 300 which encourages a person's feet to travel through adjacent elliptical paths (not shown). The foot supports 335 are arranged to be approximately one hundred and eighty degrees out of phase relative to one another.

The apparatus 300 includes a frame 310 having a floor engaging base 312 and a forward stanchion 314 that extends upward from the base 312. Left and right cranks 320 are rotatably mounted on the forward stanchion 314. The cranks 320 are connected to a stepped-up flywheel 325 by means of a belt and pulley arrangement. A user interface device 390 is mounted on top of the stanchion 314 and may be placed in communication with a resistance device connected to the flywheel 325.

The apparatus 300 demonstrates one way to rearrange the linkage assembly components of the previous embodiment 200. In particular, each crank 320 is rotatably connected to a forward portion of a respective connector link 330. An intermediate portion of each connector link 330 is rotatably connected to a lower portion of a respective rocker link 340. A removable pin 334 facilitates adjustment of the resulting pivot axis along a respective connector link 330. A rearward portion 335 of each connector link 330 is configured to support a person's foot.

Each rocker link 340 has an intermediate portion rotatably connected to a forward stanchion 314 (at 344), and an upper portion 347 sized and configured for grasping in a person's hand. As a result of this arrangement, the handles 347 move through arcuate paths as the foot supports 335 move through the elliptical paths.

Figure 11:
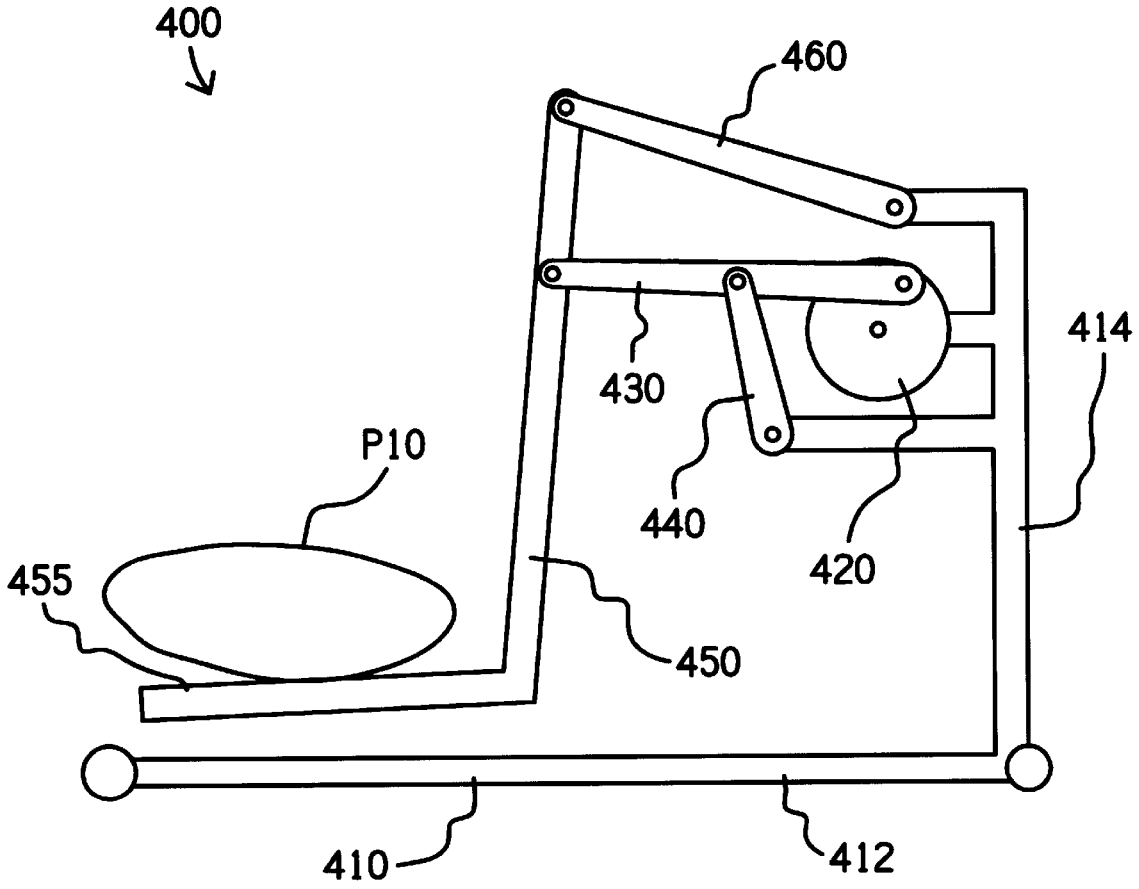
FIG. 11 is a side view of still another exercise apparatus, which shares similarities with the exercise apparatus of FIG. 1.

FIG. 11 shows another exercise apparatus 400 which encourages a person's feet to travel through adjacent elliptical paths P10. The foot supports 455 are arranged to be approximately one hundred and eighty degrees out of phase relative to one another.

The apparatus 400 includes a frame 410 having a floor engaging base 412 and a forward stanchion 414 that extends upward from the base 412. Left and right cranks 420 are rotatably mounted on the forward stanchion 414 and may be connected to a stepped-up flywheel and/or a resistance device in much the same manner as the previous embodiments.

The apparatus 400 demonstrates one way to complement the linkage assembly components of the previous embodiments. On this machine 400, each connector link 430 has a forward portion rotatably connected to a respective crank 420; an intermediate portion rotatably connected to a respective rocker link 440; and a rearward portion rotatably connected to an intermediate portion of a respective foot supporting link 450. An opposite end of each rocker link 440 is rotatably connected to the forward stanchion 414.

Each foot supporting link 450 has a lower portion 455 which is sized and configured to support a person's foot, and an upper portion which is rotatably connected to a respective rocker link 460. An opposite end of each rocker link 460 is rotatably connected to the forward stanchion 414. As a result of this arrangement, the upper ends of the foot supporting links 450 move through reciprocal paths of motion, as the lower ends of the foot supporting links 450 move through parallel elliptical paths P10.

Figure 1:
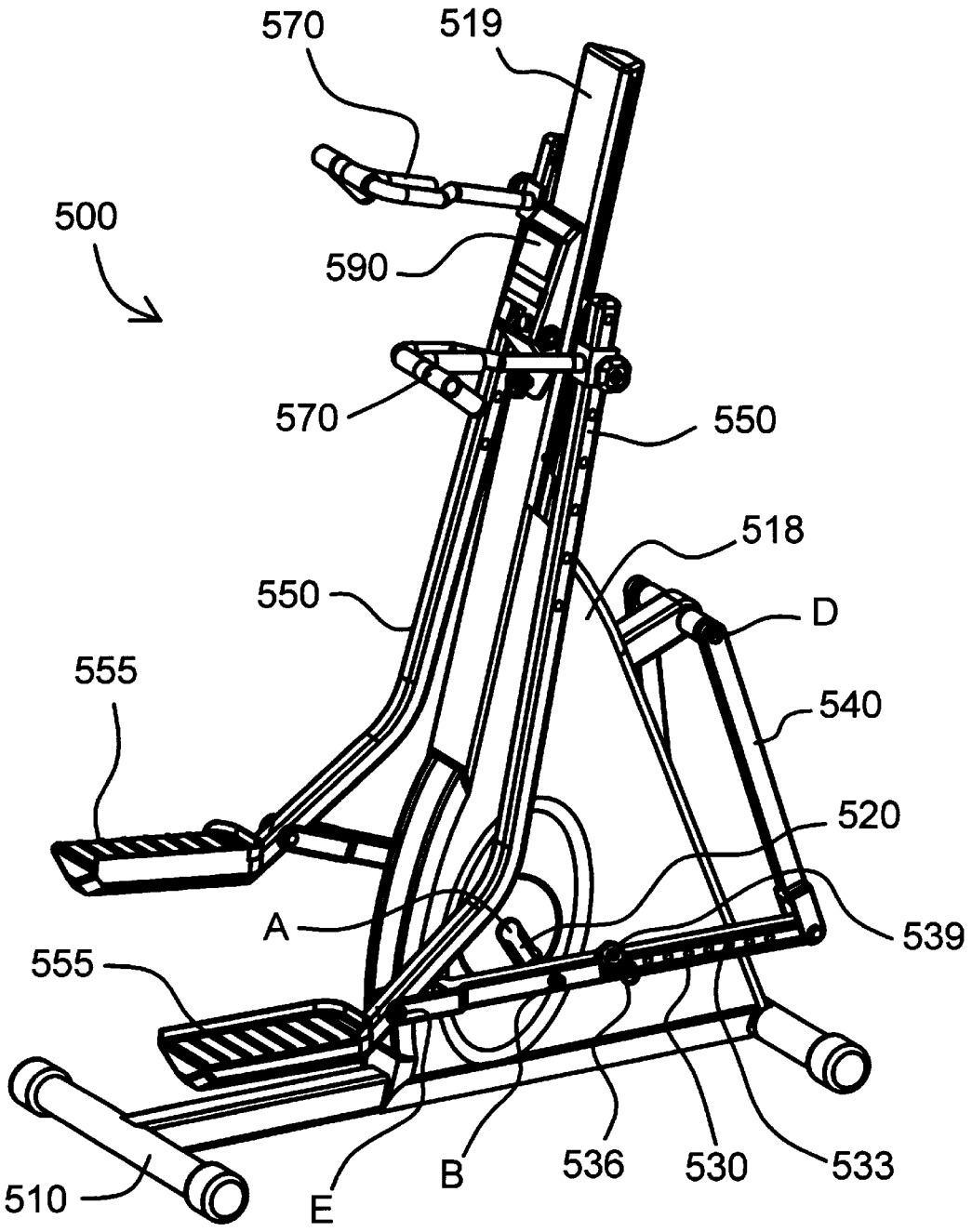
FIG. 1 is a perspective view of a first exercise apparatus constructed according to the principles of the present invention.
Figure 2:
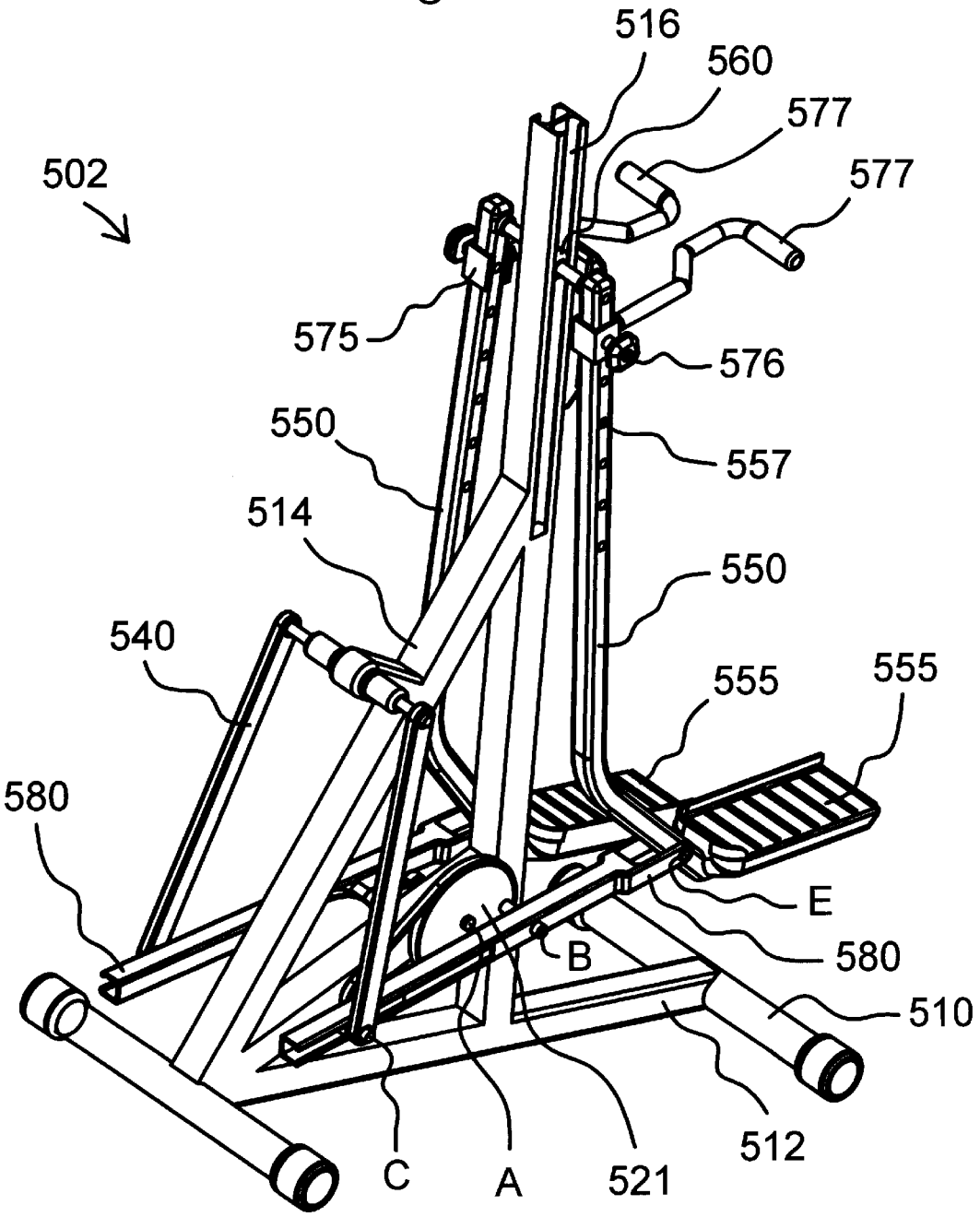
FIG. 2 is an opposite side, perspective view of a second exercise apparatus, which is similar to the exercise apparatus of FIG. 1.
Figure 3:
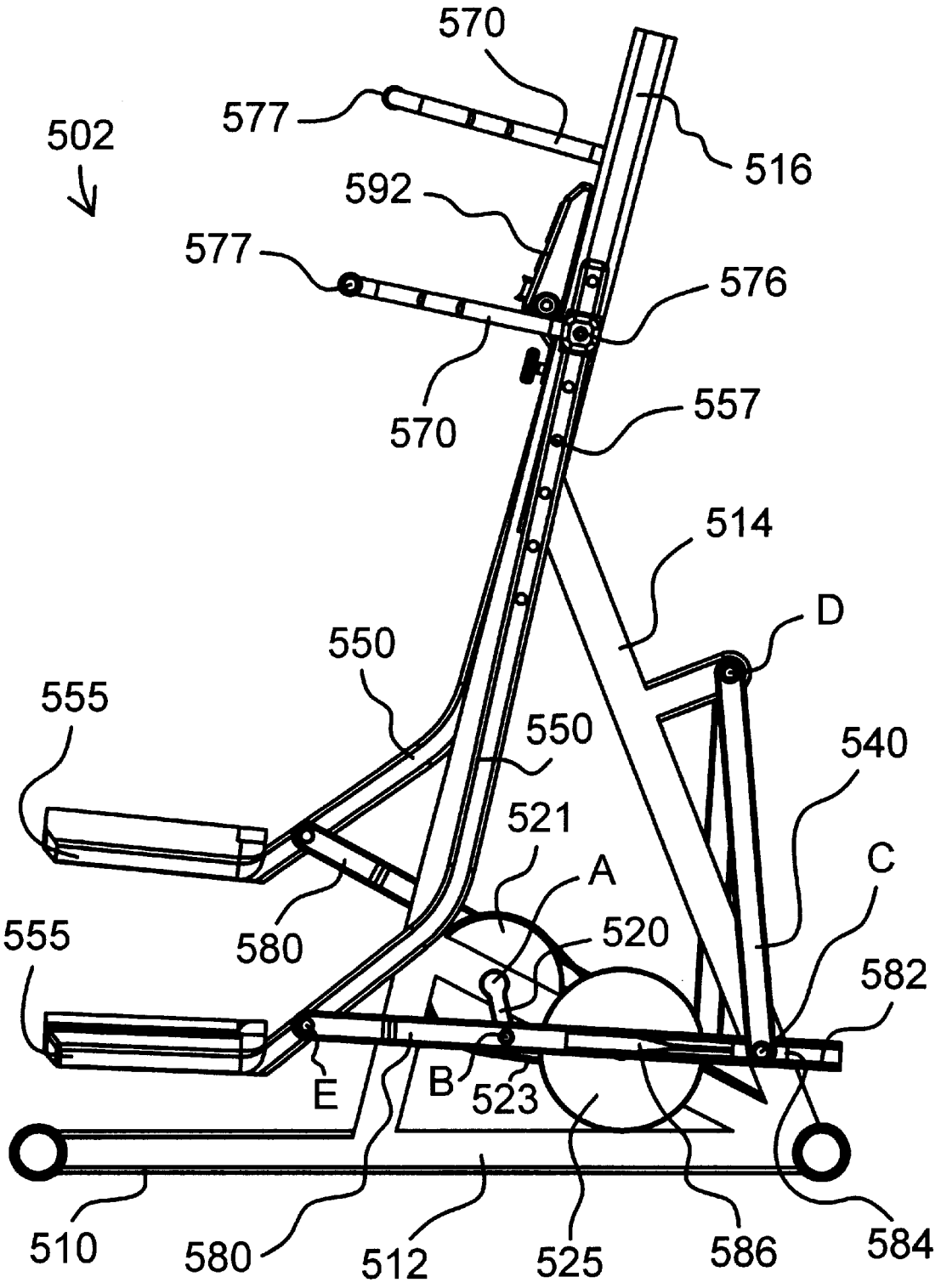
FIG. 3 is a side view of the exercise apparatus of FIG. 2.

FIGS. 1–6 show additional exercise machines which incorporate aspects of the linkage assembly arrangements on previous embodiments. For example, FIGS. 1–3 show, among other things, exercise apparatus 500 and 502 including foot supporting links 550 having upper ends which move through repeated paths of motion and lower ends which move through elliptical paths of motion. Left and right handles 577 are secured to the upper ends of the foot supporting links 550, and the lower ends 555 are sized configured to support a person's feet.

An intermediate portion of each foot supporting link 550 is rotatably connected to a rearward portion of a respective connector link 530 or 580, thereby defining respective pivot axes E. An intermediate portion of each connector link 530 or 580 is rotatably connected to a respective crank 520 or 521, thereby defining respective pivot axes B. The cranks 520 and 521 are rotatably mounted on the frame 510, thereby defining a common crank axis A. A forward portion of each connector link 530 or 580 is rotatably connected to a lower portion of a respective rocker link 540, thereby defining respective pivot axes C. An upper portion of each rocker link 540 is rotatably mounted on the frame 510, thereby defining a common pivot axis D.

Both machines 500 and 502 facilitate selective adjustment of the pivot axes C relative to respective pivot axes B for purposes of adjusting the exercise stroke. The manner in which the adjustment is accomplished constitutes the primary distinction between the two machines 500 and 502.

On the machine 500, each connector link 530 includes a tubular member interconnected between a respective crank 520 and a respective foot supporting link 550, and a rod having a forward end connected to a respective rocker link 540 and a rearward end disposed inside a respective tubular member. As a result of this arrangement, each rod is capable of moving in telescoping fashion relative to a respective tubular member. A detent pin 536 inserts through a hole in the tubular member and any of several holes 533 in the bar to establish a fixed distance between respective pivot axes B and C. A set screw 539 is threaded through the tubular member and against the rod to enhance the stability of the connecting link 530. Although this manual adjustment arrangement is relatively practical, it requires a user to stop exercising and adjust each connector link 530 independently.

On the machine 502, each connector link 580 includes a rail 582 interconnected between a respective crank 520 and a respective foot supporting link 550 (and extending forward beyond the former), and a block 584 slidably mounted within a channel defined by the rail 582. A lower end of each rocker link 540 is rotatably connected to a respective block 584. A linear actuator 586 or other adjustable length device is disposed inside the channel of the rail 582, between a respective crank 520 and a respective block 584. As a result of this arrangement, each block 584 may be selectively moved relative to a respective rail 582 to adjust the distance between respective pivot axes B and C. This automated adjustment arrangement is relatively more involved, but it facilitates adjustment during exercise and/or the push of a single button on user interface device 592. In this regard, those skilled in the art will recognize that wires, with just enough slack to accommodate movement of the connector links 580, may be routed from the device 592 along the stanchion 514 and to respective actuators 586. Those skilled in the art will also recognize that linear actuators may be used together with the telescoping arrangement on the machine 500, and/or that manually operated pins may be used together with the sliding block arrangement on the machine 502.

On each of the machines 500 and 502, the frame 510 includes a floor engaging base 512, as well as the stanchion 514 extending upward from the base 512. FIGS. 2–3 show the cranks 520 and 521 connected to a stepped-up flywheel 525 by means of a belt 523. As on the other embodiments described herein, any of various known resistance devices (such as a tensioned drag strap, for example) may be connected to the flywheel 525 to resist rotation thereof. Those skilled in the art will recognize that either of the user interface devices 590 or 592 may be designed to adjust resistance at the push of a button. FIG. 1 shows one way to shroud certain components of the linkage assembly, using left and right side panels 518 and a rail cover 519, for example.

On each of the machines 500 and 502, the upper end of each foot supporting link 550 is connected to a respective roller 560 which travels along a respective track 516 defined by stanchion 514, as shown in FIG. 2. This arrangement constrains the upper end of each foot supporting link 550 to travel back and forth along a linear path as the cranks 520 and 521 rotate. Handle members 570 have first ends 575 which fit about respective foot supporting members 550 in telescoping fashion, and second ends 577 which are sized and configured for grasping. As the cranks 520 and 521 rotate, the second ends 577 travel in elliptical paths having a relatively large aspect ratio between the major and minor axes.

The first ends 575 are secured in any of various positions along respective foot supporting links 550 by means of a fastener (such as a detent pin, for example) inserted through a hole in a respective first end 575 and any of several holes 557 along a respective foot supporting link 550. A knob 576 is connected to each fastener to facilitate manipulation thereof. As a result of this arrangement, the machines 500 and 502 may be readily adjusted for people of various heights.

Figure 4:
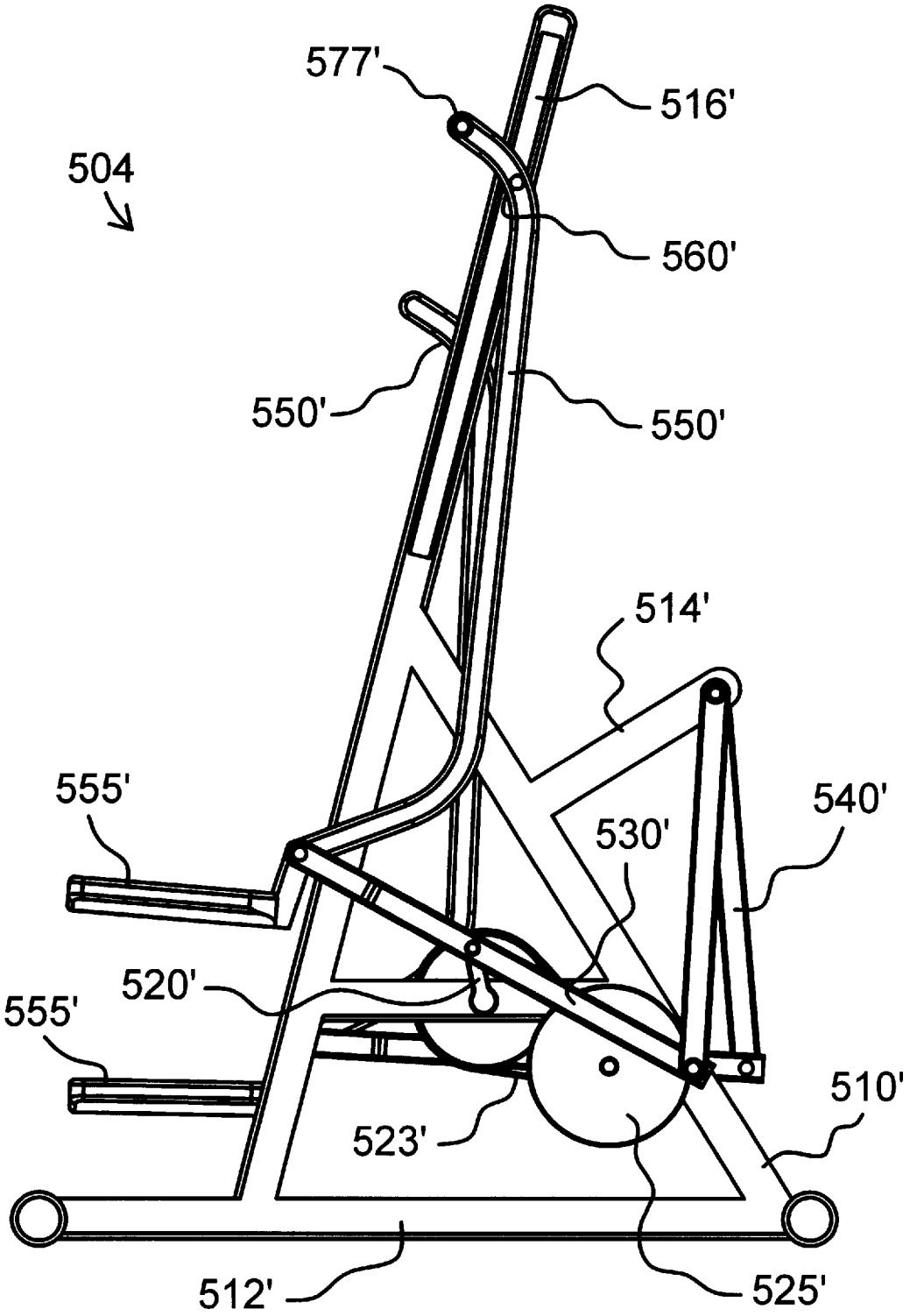
FIG. 4 is a side view of a third exercise apparatus, which is similar to the exercise apparatus of FIG. 1.

FIG. 4 shows a machine 504 which is similar in many respects to the foregoing embodiments 500 and 502, but sacrifices versatility in exchange for simplified construction. The machine 504 similarly includes a frame 510' having a base 512' designed to rest upon a horizontal floor surface, and a stanchion 514' extending upward from the base 512'. Left and right cranks (one of which is shown and designated as 520') are rotatably mounted on the stanchion 514' and connected to a flywheel 525' by means of a belt 523'. Left and right connector links 530' have intermediate portions rotatably connected to respective cranks, forward ends rotatably connected to respective rocker links 540', and rearward ends rotatably connected to respective foot supporting links 550'. Upper ends of the rocker links 540' are rotatably mounted on the stanchion 514'. Upper portions of the foot supporting links 550' are movably connected to the stanchion 514' by means of respective rollers 560' and tracks 516'. Upper distal ends 577' of the foot supporting links 550' are sized and configured for grasping. Lower distal ends 555' of the foot supporting links 550' are sized and configured to support a person's feet.

As the cranks rotate, the intermediate portions of the connector links 530' are constrained to rotate about the crank axis; and the rocker links 540' constrain the forward ends of the connector links 530' to move in reciprocal fashion relative to the frame 510'; and the rearward ends of the connector links 530' are constrained to move through elliptical paths. The rollers 560' and tracks 516' constrain the upper portions of the foot supporting links 550' to move in reciprocal fashion relative to the frame 510'; and both the lower and upper distal ends 555' and 577' of the foot supporting links 550' are constrained to move through elliptical paths.

Figure 5:
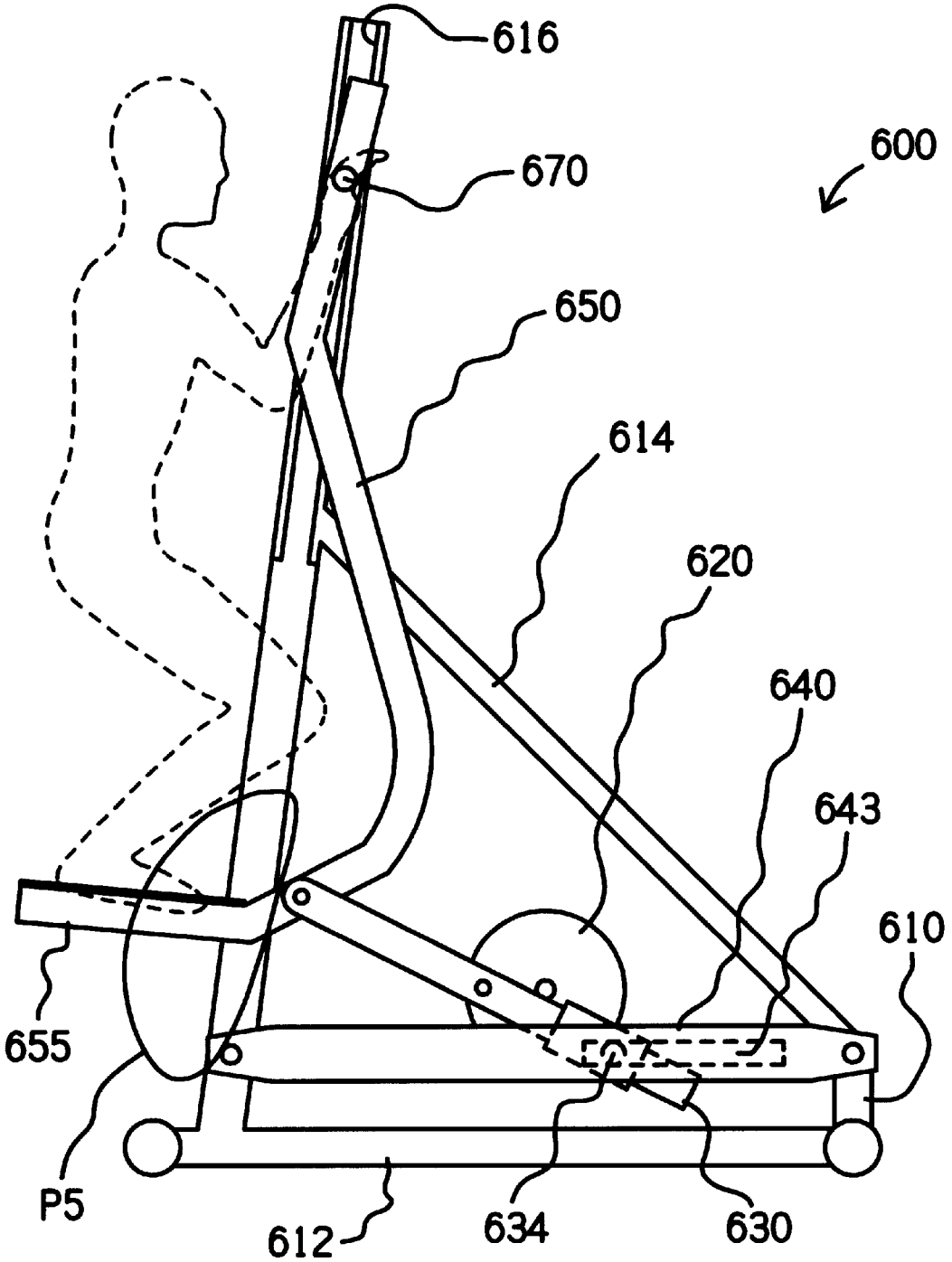
FIG. 5 is a side view of a fourth exercise apparatus, which is similar to the exercise apparatus of FIG. 1.
Figure 6:
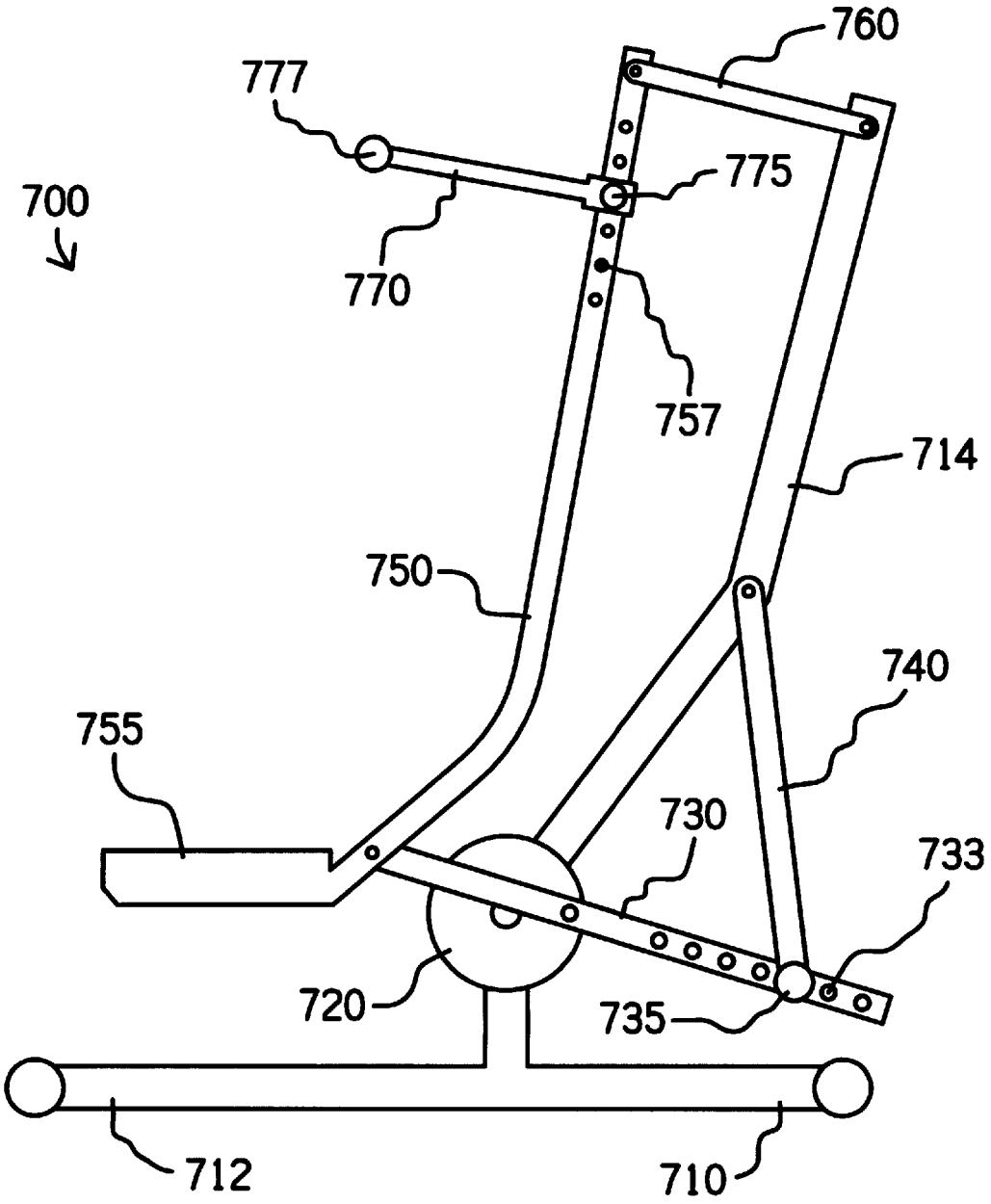
FIG. 6 is a side view of a fifth exercise apparatus, which is similar to the exercise apparatus of FIG. 1.

FIG. 5 shows a machine 600 having a sliding arrangement in lieu of the rockers 540 or 540' on the previous embodiments. In particular, a stud or roller 634 is connected to a forward end of each connector link 630 and disposed inside a guide or track 643 defined by a respective rail 640. Each rail 640 constrains the forward end of a respective connector link 630 to move in reciprocal fashion. As on the previous embodiments 500 and 502, the exercise stroke may be adjusted by selectively relocating the rollers 634 relative to respective connector links 630. For example, a linear actuator is mounted on each connector link 630 to selectively adjust the distance between the crank axis and a respective roller 634. Also, adjustments to both sides of the linkage assembly may be made using a single actuator to move both rails 640 together relative to the frame 600. Those skilled in the art will also recognize that the rollers 634 and the tracks 643 may be reversed, in that tracks may be provided on the connector links to receive rollers mounted on the frame.

As on the other embodiments, an intermediate portion of each connector link 630 is rotatably connected to a respective crank 620, and a rearward portion of each connector link 630 is rotatably connected to a respective body supporting link 650. A lower distal end 655 of each body supporting link 650 is sized and configured to support a person's foot. Tracks 616 cooperate with rollers to constrain the upper distal end of each body supporting link 650 to move in reciprocal fashion relative to the frame 600. A handle 670, sized and configured for grasping, is connected to each body supporting link 650 proximate the upper end thereof.

Those skilled in the art will recognize that each of the components of the linkage assembly is necessarily long enough to facilitate the required interconnections but need not terminate immediately beyond the points of connection. Furthermore, for ease of reference in both this detailed description and the claims set forth below, the components are sometimes described with reference to "ends" that are connected to other parts. However, a term such as "rear end" should be interpreted broadly, in a manner that could include "rearward portion" and/or "behind an intermediate portion", for example. In other words, both the handle 670 and the roller may be said to be connected to an upper end of a respective body supporting link 650. Those skilled in the art will further recognize that the components of the linkage assembly may be arranged and/or interconnected in a variety of ways without departing from the scope of the present invention, and that the spatial relationships may vary for different sizes, configurations, and/or arrangements of the components of the linkage assembly.

As suggested by the foregoing embodiment 600, rocker links may be substituted for the rollers and tracks used to guide the upper ends of the body supporting links. Such a machine is designated as 700 in FIG. 6. The machine 700 includes a frame 710 having a floor engaging base 712 and a stanchion 714 extending upward from the base 712. Left and right cranks 720 are rotatably mounted on the stanchion 714 and rotatably connected to intermediate portions of respective connector links 730. Forward portions of respective connector links 730 are rotatably connected to lower portions of respective rocker links 740. An upper portion of each rocker link 740 is rotatably connected to the stanchion 714. The connection point between each connector link 730 and a respective rocker link 740 may be adjusted along the former by means of holes 733 and a fastener 735 (or other suitable means, including those described with reference to previous embodiments).

Rearward portions of respective connector links 730 are rotatably connected to respective body supporting links 750. A relatively lower portion 755 of each body supporting link 750 is sized and configured to support a person's foot. A relatively higher portion of each body supporting link 750 is rotatably connected to a respective rocker link 760, which in turn, is rotatably connected to the stanchion 714. Each rocker link 760 constrains an upper portion of a respective body supporting link 750 to move in reciprocal fashion relative to the frame 710.

Left and right handle members 770 have first ends 775 which are connected to respective body supporting members 750 proximate the upper ends thereof, and second ends 777 which are sized and configured for grasping. The connection point between each body supporting link 750 and a respective handle member 770 may be adjusted along the former by means of holes 757 and a fastener 775 or other suitable means.

Figure 7:
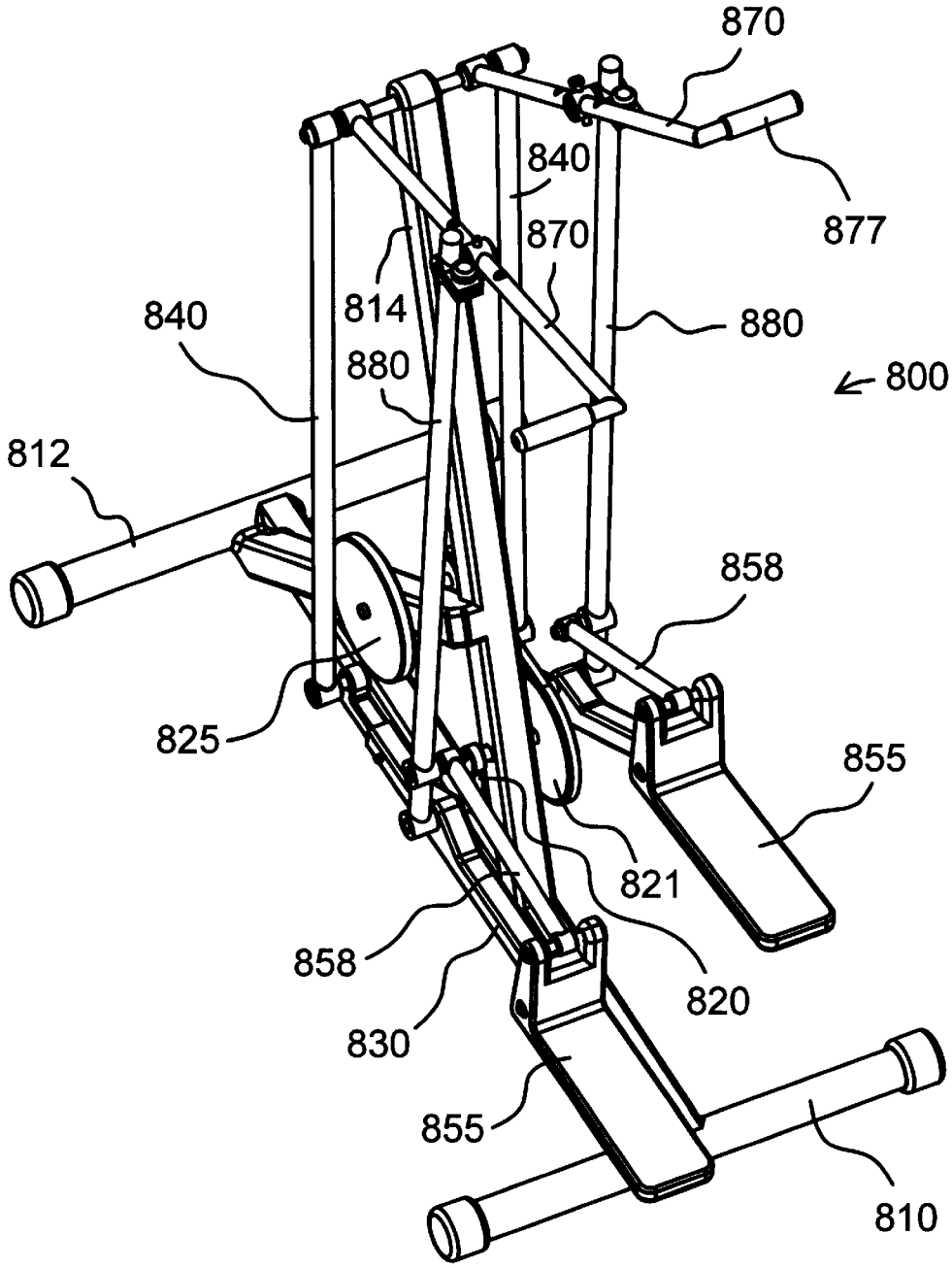
FIG. 7 is a perspective view of a sixth exercise apparatus, which shares similarities with the exercise apparatus of FIG. 1.

FIG. 7 shows another machine 800 having upper rocker links in lieu of rollers and tracks. In particular, left and right rocker links 870 are rotatably connected to a stanchion 814. A distal end 877 of each rocker link 870 is sized and configured for grasping. An intermediate portion of each rocker link 870 is rotatably connected to an upper portion of a respective intermediate link 880. The resulting points of connection are selectively movable along respective rocker links 870 to adjust the range of motion of handles 877.

A lower portion of each intermediate link 880 is rotatably connected to an intermediate portion of a respective connector link 830. The intermediate portion of each connector link 830 is also rotatably connected to a respective crank 820 or 821. The cranks are connected to a stepped-up flywheel 825 in a manner already known in the art. A forward portion of each connector link 830 is rotatably connected to a respective rocker link 840. The rocker links 840 constrain the forward ends of respective connector links 830 to move in reciprocal fashion relative to the frame 810.

Left and right foot platforms 855 are rotatably connected to rearward ends of respective connector links 830. Stabilizing links 858 are rotatably connected between respective foot platforms 855 and intermediate portions of respective intermediate links 880. The stabilizing links 858 cooperate with the connector links 830 to maintain the foot platforms 855 substantially level through an exercise cycle. As the cranks 820 and 821 rotate, the foot platforms 855 move through generally elliptical paths having generally vertical major axes, and the handles 877 move through arcuate paths which are generally vertical, as well.

Those skilled in the art will recognize that the present invention may be described in terms of an exercise apparatus having left and right user supporting assemblies which support a person in an upright position relative to an underlying floor surface. The user supporting assemblies are interconnected between the frame and respective left and right cranks in such a manner that rotation of the cranks is linked to movement of respective foot platforms and handles through generally vertical paths of motion. Those skilled in the art will recognize that fixed handles may also be provided on any of the foregoing embodiments.

The present invention may also be described in terms of a method of simulating climbing motion relative to an underlying floor surface, including the steps of: providing a frame adapted to rest upon the floor surface; rotatably mounting left and right cranks on the frame; connecting first portions of left and right connector links to respective cranks; constraining second portions of left and right connector links to move in reciprocal fashion relative to said frame; and interconnecting left and right user supporting assemblies between said frame and respective connector links in such a manner that rotation of said cranks is linked to movement of a user's hands and feet through respective closed curve paths having major axes which are generally perpendicular to the floor surface and parallel to one another.

Although the present invention has been described with reference to specific embodiments and particular applications, those skilled in the art will recognize additional embodiments, modifications, and/or applications which fall within the scope of the present invention. Accordingly, the scope of the present invention is to be limited only to the extent of the claims which follow.

What is claimed is:

1. An exercise apparatus, comprising:

a frame designed to rest upon a floor surface;

left and right cranks rotatably mounted on said frame;

left and right horizontal links, each of said horizontal links having a first portion rotatably connected to a respective crank, a second portion constrained to move in reciprocal fashion relative to said frame, and a third portion constrained to move through a closed curve path having a major axis; and left and right vertical links, each of said vertical links having a lower portion rotatably connected to at least one of a respective horizontal link and a respective crank, and an upper portion constrained to move in reciprocal fashion relative to said frame;

left and right foot supports, each of said foot supports supported by at least one of a respective vertical link and a respective horizontal link; and left and right handles, each of said handles supported by a respective vertical link.

2. The exercise apparatus of claim 1, wherein a left rocker link is rotatably interconnected between said frame and said forward end of said left horizontal link, and a right rocker link is rotatably interconnected between said frame and said forward end of said right horizontal link.

3. The exercise apparatus of claim 2, wherein said left rocker link and said left horizontal link rotate relative to one another about a pivot axis which is selectively movable along said left horizontal link, and said right rocker link and said right horizontal link rotate relative to one another about a pivot axis which is selectively movable along said right horizontal link.

4. The exercise apparatus of claim 1, wherein each said upper portion is connected to a respective roller which is movable along a respective track defined by the frame.

5. The exercise apparatus of claim 1 wherein each of said handles is selectively movable along a respective vertical link.

6. The exercise apparatus of claim 1, wherein each of said handles is selectively movable along a respective vertical link.

7. The exercise apparatus of claim 1, wherein each of said handles is constrained to move through a closed curve path having a vertical major axis.

8. The exercise apparatus of claim 1, wherein each of said foot supports is rigidly mounted to a respective vertical link.

9. The exercise apparatus of claim 1, further comprising a flywheel rotatably mounted on said frame and operatively connected to at least one of said cranks.

10. An exercise apparatus, comprising:

a frame designed to rest upon a floor surface;

left and right cranks rotatably mounted on said frame;

left and right horizontal links, each of said horizontal links having a first portion rotatably connected to a respective crank, a second portion constrained to move in reciprocal fashion relative to said frame, and a third portion constrained to move through a closed curve path having a major axis and a relatively shorter minor axis; and left and right vertical links, each of said vertical links having a lower portion sized and configured to support a person's foot, an intermediate portion rotatably connected to said third portion of a respective horizontal link, and an upper portion constrained to move in reciprocal fashion relative to said frame.

11. The exercise apparatus of claim 10, wherein each said first portion is disposed between a respective second portion and a respective third portion.

12. The exercise apparatus of claim 10, further comprising left and right handles connected to respective vertical links.

13. The exercise apparatus of claim 12, wherein each of said handles is selectively movable along a respective vertical link.

14. The exercise apparatus of claim 10, wherein each said upper portion moves along a respective track defined by said frame.

15. The exercise apparatus of claim 10, wherein a left rocker link is rotatably interconnected between said frame and said third portion of said left horizontal link, and a right rocker link is rotatably interconnected between said frame and said third portion of said right horizontal link.

16. The exercise apparatus of claim 15, wherein each said rocker link cooperates with a respective horizontal link to define a pivot axis, and each said pivot axis is selectively movable along a respective horizontal line.

* * * * *